US007263813B2

(12) United States Patent
Schneider et al.

(10) Patent No.: US 7,263,813 B2
(45) Date of Patent: Sep. 4, 2007

(54) RECLOSABLE PACKAGE METHODS FOR BLOCK CHEESE AND OTHER PRODUCTS THAT DO NOT SLIDE WELL

(75) Inventors: John H. Schneider, Frankfort, IL (US); Donald L. Crevier, Essex, IL (US); Patricia I. Norek, Manteno, IL (US)

(73) Assignee: Illinois Tool Works Inc., Glenview, IL (US)

( * ) Notice: Subject to any disclaimer, the term of this patent is extended or adjusted under 35 U.S.C. 154(b) by 206 days.

(21) Appl. No.: 11/209,917

(22) Filed: Aug. 23, 2005

(65) Prior Publication Data

US 2005/0279053 A1 Dec. 22, 2005

Related U.S. Application Data

(62) Division of application No. 10/057,415, filed on Jan. 25, 2002, now Pat. No. 6,931,819.

(51) Int. Cl.
*B65B 43/04* (2006.01)
*B65B 61/18* (2006.01)

(52) U.S. Cl. ..... 53/412; 53/449; 53/455; 53/133.4; 53/562

(58) Field of Classification Search ..... 53/133.4, 53/139.2
See application file for complete search history.

(56) References Cited

U.S. PATENT DOCUMENTS 6,088,998 A * 7/2000 Malin et al. ..... 53/416
6,327,837 B1 * 12/2001 Van Erden ..... 53/412
6,350,340 B1 * 2/2002 Johnson ..... 156/252
7,114,309 B2 * 10/2006 Ausnit ..... 53/412

* cited by examiner

*Primary Examiner*—John Sipos
(74) *Attorney, Agent, or Firm*—Day Pitney LLP

(57) ABSTRACT

A method of making a reclosable product package (64, 100, 142), a package-making apparatus (10) for the method and the reclosable product package (64, 100, 142) in which block cheese or another product (45) which does not slide well during packaging in placed on a continuous length of thermoplastic packaging film (12). Various folding directions (44, 62, 90, 106, 114) of the packaging film (12) and various placement of reclosable zippers (73, 108, 119) produce various reclosable product packages (64, 100, 142) with various peel seal (40, 41, 87, 88) arrangements.

6 Claims, 13 Drawing Sheets

RECLOSABLE PACKAGE METHODS FOR BLOCK CHEESE AND OTHER PRODUCTS THAT DO NOT SLIDE WELL

This is a divisional of U.S. patent application Ser. No. 10/057,415 filed on Jan. 25, 2002, now U.S. Pat. No. 6,931,819.

FIELD OF THE INVENTION

The present invention relates to reclosable product packages of the type in which perishable food products and other goods are packaged for sale to consumers in retail outlets. More specifically, the present invention relates to a reclosable product package, a apparatus for and a method of making the product package to effectively package block cheese and other products that do not slide well during packaging, in order for the products to be put into a cheese box or other container.

DESCRIPTION OF THE PRIOR ART

The present invention relates to improvements in the package-making art and may be practiced in the manufacture of reclosable thermoplastic bags and packages of the kind that may be used for various consumer products. Such packages often include a form of peel seal to render the pack moisture-tight and/or airtight prior to the initial opening. A zipper means protects any remainder of the product therein after the initial opening.

The indicated art is fairly well developed but nevertheless remains open to improvements contributing to increased efficiency of manufacturing. In the prior art, Malin et al. (U.S. Pat. No. 6,185,907) discloses a horizontal form-fill-and-seal (HFFS) machine in which a continuous length of packaging is folded lengthwise over the products to be packaged and the edges are aligned. A zipper is fed between the aligned longitudinal edges of the packaging film. The longitudinal edges are sealed to one another, and a pair of parallel sealing devices seals the zipper to the folded packaging film. Side seals are produced by conventional means, which also separate the completed packages from the packages being formed.

An improvement in the use of machines that dispense packaging film in a horizontal manner would be an enhanced ability to package block cheese and other products that do not slide well during packaging. This enhanced ability could reduce snagging or interference with dispensers which position the product to be packaged on the package-making machine. Existing packaging methods could also be improved to provide various reclosable fastener and peel seal arrangements. The various reclosable fastener and peel seal arrangements would increase the sealing properties of the package after a user opens it.

SUMMARY OF THE INVENTION

Accordingly, the present invention relates to a method for producing a reclosable product package, an apparatus used for making the reclosable product package and the resultant reclosable product package. In the package-making method, a continuous length of thermoplastic packaging film is dispensed in a bag-forming direction.

In a first embodiment of the present invention, a first profile from a continuous supply of zippers is attached transverse to a longitudinal edge of a continuous length of packaging film, with the first profile including a first set of at least two interlocking members. The packaging film and the first profile are cut at a first cut between the two interlocking members of the first profile. The packaging film is advanced to accommodate at least one product and a second profile from the continuous supply of zippers is attached transverse to the longitudinal edges of the packaging film with the second profile including a second set of at least two interlocking members, the interlocking members of the first profile being mateable with the interlocking members of the second profile. The packaging film and the second profile are then cut at a second cut between the two interlocking members, with the result of a packaging sheet having at least one of the first interlocking members of the first profile and at least one of the second interlocking members of the second profile at opposite ends of the packaging sheet. The packaging sheet is folded at a fold transverse to the longitudinal edges and opposing inner surfaces are sealed at the longitudinal edges to form an envelope. The interior faces of the packaging sheet adjacent to the fold are sealed to form a transverse peel seal. The envelope is then placed in a box with the interlocking members protruding from the box. A product is placed into the envelope, which is in the box when the interlocking members are mated.

In a second embodiment of the present invention, a continuous length of packaging film is advanced to accommodate at least one product. A zipper is supplied from a zipper dispenser with the zipper having a first profile with a first interlocking member and a second profile with a second interlocking member with the first and second interlocking members interengaged. The first profile is attached to the packaging film transverse to the longitudinal edges of the packaging film. The packaging film is cut adjacent to the first profile and the packaging sheet is folded at a fold transverse to the longitudinal edges. The opposing inner surfaces of the longitudinal edges are sealed to form an envelope. The interior faces of the packaging sheet adjacent to the fold are sealed to form a transverse peel seal. The envelope is placed in a box with the zipper and an opposing face of the envelope opposite to the zipper protruding from the box. The product is placed into the envelope and the second profile of the zipper is attached to the packaging sheet to form a reclosable product package in the box.

In a third embodiment of the present invention, a zipper is supplied with the zipper having a first profile with a first interlocking member and a second profile with a second interlocking member with the first and second interlocking members interengaged with each other. The first profile of the zipper is attached to a mid-portion of a continuous length of packaging film with the zipper disposed transverse to the longitudinal edges of the packaging film, leaving side margins of film on opposite ends of the zipper. At least one product is placed along a central axis of the packaging film. The side margins are folded over the product and sealed in a fin seal to form a tube. Peel seals are formed within the tube adjacent to the longitudinal sides of the product and the second profile of the zipper is sealed to the inner surface of the tube. The tube is cut adjacent to a forward transverse edge of the zipper and cross-sealed.

In a fourth embodiment of the present invention, the side margins of the film are sealed under the product in a fin seal to form a tube, rather than above the product as described above.

In a fifth embodiment of the present invention, a product is placed along one longitudinal half of a continuous length of packaging film transverse to the longitudinal edges of the packaging film. A continuous supply of zippers is supplied with the zippers having a first profile with a first interlocking member and a second profile with a second interlocking member with the first and second interlocking members interengaged. The continuous supply of zippers is placed between the product and a first longitudinal edge of the packaging film. The packaging film is folded down the center thereof and over the product. The continuous supply of zippers is sealed to the folded length of packaging film. The inner surfaces of the folded length of packaging film are peel sealed adjacent to the product, transverse to the longitudinal edges. The longitudinal edges of the folded packaging film are sealed to one another. The folded packaging film is sealed crosswise at intervals adjacent to the product to create a reclosable product package.

In a sixth embodiment of the present invention, the continuous length of packaging film is advanced to accommodate at least one product. A continuous supply of zippers is supplied with the zippers having a first profile with a first interlocking member and a second profile with a second interlocking member with the first and second interlocking members interengaged. A zipper length is cut from the continuous supply of zippers and the first profile of the zipper length is sealed adjacent to a first longitudinal edge of the packaging film with the zipper length parallel to the edge. The packaging film is cut transverse to the longitudinal edges at a point adjacent to the zipper length such that the cut sheet is more than twice the zipper length. The cut packaging sheet is folded at a first fold adjacent to the attached zipper area and transverse to the longitudinal edges and the opposing inner surfaces of longitudinal edges are sealed from the transverse edges to the first fold, forming an envelope. The second profile of the zipper is sealed to the packaging sheet and the interior faces of the fold are sealed to form a first peel seal. The envelope is placed in a box with the transverse edges protruding from the box. The product is placed within the envelope and the transverse edges are sealed with a second peel seal.

DESCRIPTION OF THE DRAWINGS

Further objects and advantages of the invention will become apparent from the following description and claims and from the accompanying drawings, wherein:

DETAILED DESCRIPTION OF THE PREFERRED EMBODIMENTS

Figure 1:
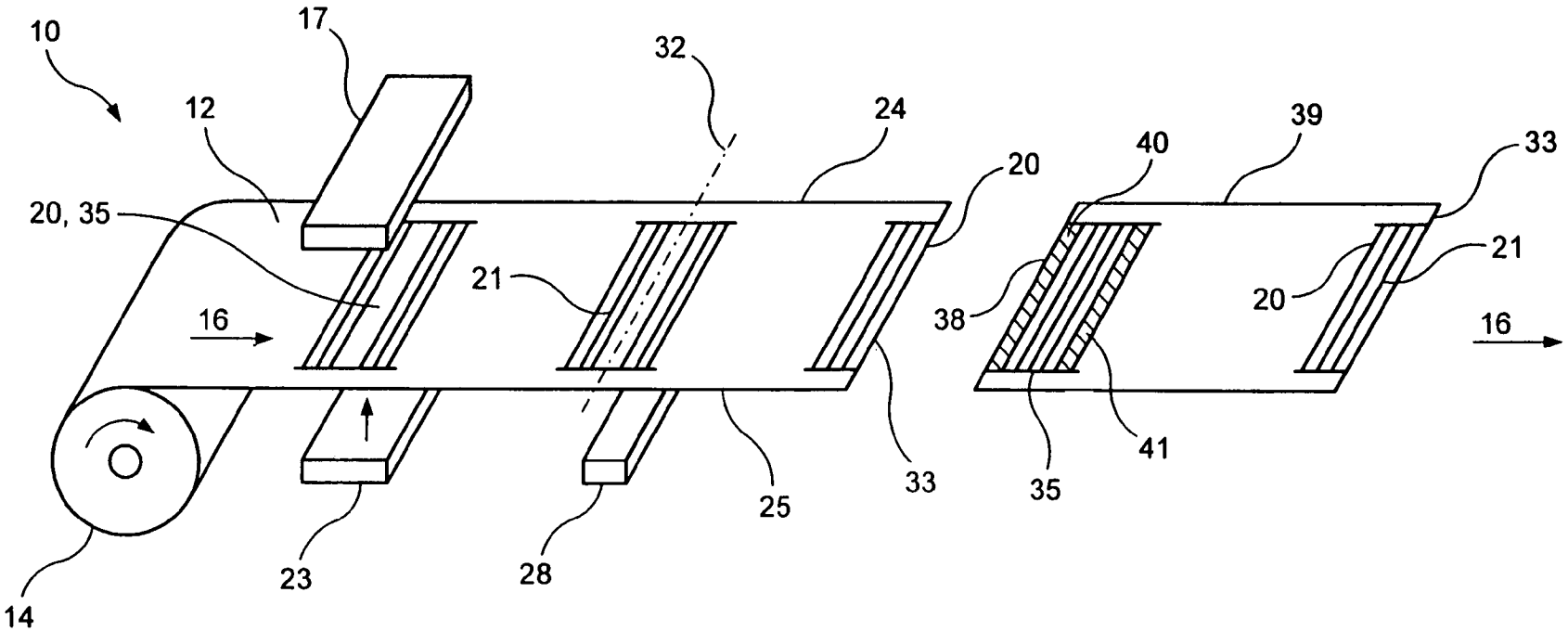
FIG. 1 is a perspective view of a first embodiment of the present invention during a zipper placement and a zipper cutting operation.

Referring now to the drawings in detail wherein like numerals indicate like elements throughout the several views, a perspective view of a package-making apparatus 10 is shown in FIG. 1. In the figure, a continuous length of thermoplastic packaging film 12 is dispensed flat from a supply dispenser 14 in direction 16.

Figure 3:
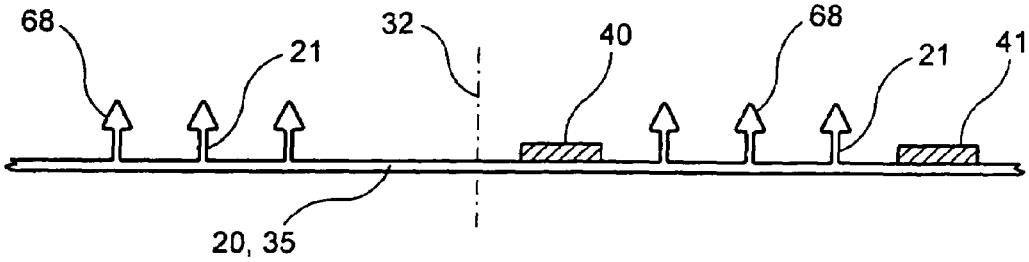
FIG. 3 is a detailed view of a first type of profiles with interlocking members which may be used with the present invention with the interlocking members shown as male ribs with double barbed end sections.
Figure 4:
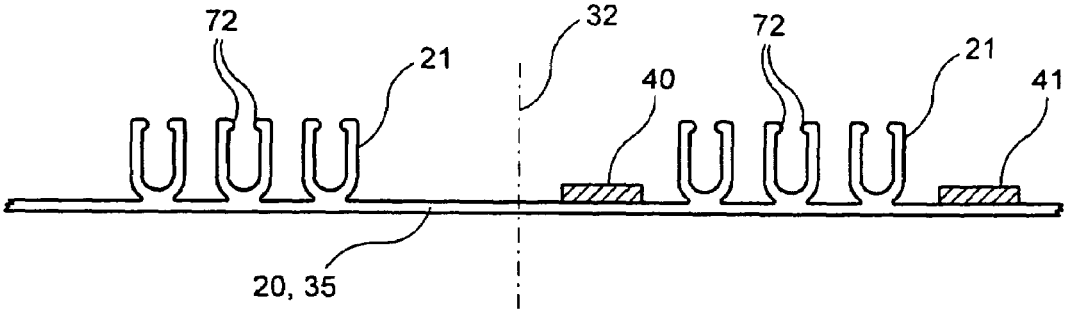
FIG. 4 is a detailed view of a second type of profiles with interlocking members which may be used with the present invention with the interlocking members shown as U-shaped ribs with single barbed end sections.
Figure 5:
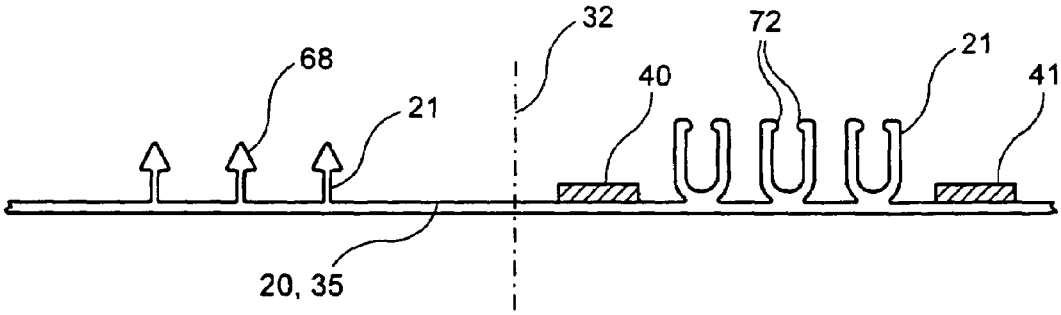
FIG. 5 is a detailed view of a third type of profiles with interlocking members which may be used with the present invention with the interlocking members shown as male ribs with double barbed end sections matching to U-shaped ribs with single barbed end sections.

A zipper dispenser 17 feeds a first profile 20 to the packaging film 12. The first profile 20, which includes at least two interlocking members 21, is sealed by a sealing bar 23 to a midsection of the packaging film 12. The first profile 20 extends transverse to longitudinal edges 24 and 25 of the film. FIGS. 3, 4 and 5 provide a detailed view of the profile 20 and a profile 35, each profile including interlocking members which may be used with the package-making apparatus 10 of the present invention; however, alternative profiles with interlocking members known to those skilled in the art may be substituted.

After the first profile 20 is attached to the packaging film 12, a cutter 28 cuts the packaging film and the first profile 20. The cutter 28 cuts along an axis 32 transverse to the longitudinal edges 24 and 25, with the first cut 33 positioned between two of the interlocking members 21 of the profile 20. Cutting, slicing, or any other separating method known to those skilled in the art may accomplish the cut along the axis 32. The packaging film 12 is advanced in direction 16 for a spacing to accommodate at least one product.

A second profile 35 is dispensed from the zipper dispenser 17. The second profile 35 with interlocking members 21 is sealed by the sealing bar 23 to the midsection of the packaging film 12. The second profile 35 extends transverse to longitudinal edges 24 and 25 of the film. After the second profile 35 is attached to the packaging film 12, the cutter 28 cuts the packaging film and the second profile 35. The cutter 28 cuts along the axis 32 with the second cut 38 positioned between two of the interlocking members 21. After the second cut is made, a packaging sheet 39 is produced with the first profile 20 disposed at the first cut 33 and the second profile 35 disposed at the second cut 38.

An upper peel film area 40 and a lower peel film area 41 are shown on the second profile 35; however, the upper and the lower peel film areas may be alternatively positioned on the first profile 20. The upper and the lower peel film areas 40 and 41 can be used together or separately and are discussed further below. The peel film areas 40 and 41 as well as other peal film or peel seal areas noted in the application may comprise peel seal material printed on or the peel seal may be formed by any other conventional method known to those skilled in the art.

Figure 2:
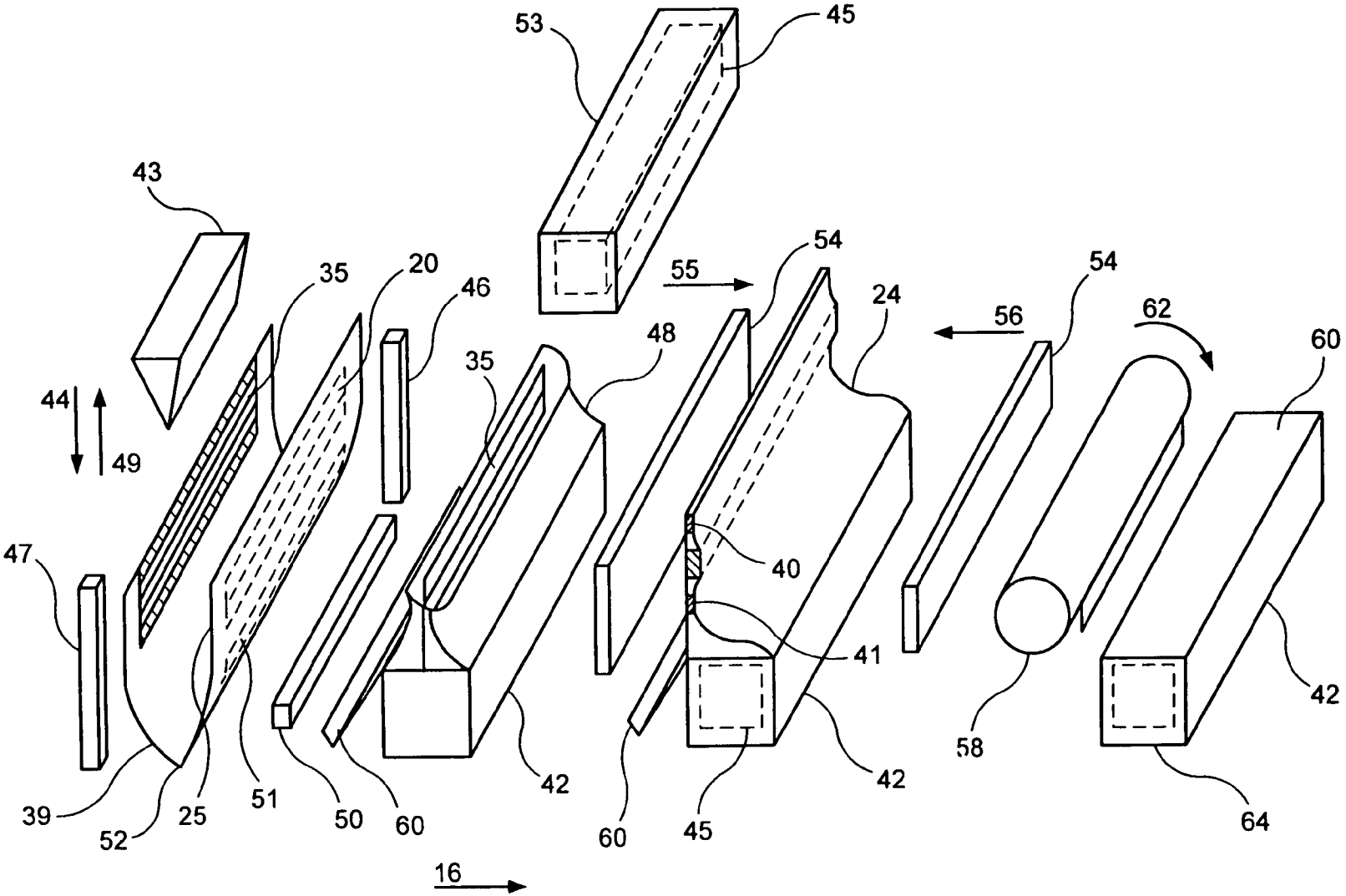
FIG. 2 is a perspective view of the first embodiment of the present invention during a packaging film and a product placement.

As shown in FIG. 2, the packaging sheet 39 is ultimately placed in a box 42. A fold blade 43, moving in direction 44, folds and separates the packaging sheet with enough space to allow placement of a block of cheese or another product 45. Seal bars 46 and 47 seal the longitudinal edges 24 and 25 while the packaging sheet 39 is separated. After the sealing of the longitudinal edges, a resultant envelope is formed. Once the envelope 48 is formed, the fold blade 43 is retracted in direction 49. Another seal bar 50 seals the packaging sheet 39 to form a transverse peel seal 51 adjacent to the fold 52.

A product dispenser 53 places the envelope 48 and the product 45 in the box 42. Once the envelope 48 and the product 45 have been placed in the box 42, a sealing device 54 moving in directions 55 and 56 interlocks the profiles 20 and 35. The sealing device 54 also seals one or both of the peel film areas 40 and 41. A box closer 58 folds the envelope 48 and lowers a box lid 60 in direction 62, thereby enclosing a reclosable product package 64 in the box 42. During use of the resultant product package 64 and after the product 45 is removed, the peel seal 51 may be opened. The opened peel seal increases the volume of the product package 64 allowing easy reinsertion of the product 45 into the package.

FIG. 3 depicts a first type of the profiles 20 and 35 with interlocking members 21, which may be used with the present invention. In the figure, a plurality of interlocking members 21 on the first profile 20 is matched to another plurality of interlocking members 21. Similarly, a plurality of interlocking members 21 on the second profile 35 is matched to another plurality of interlocking members 21. The interlocking members are shown in the figure as male ribs, each with a double barbed end section 68. During packaging, the double barbed end sections 68 secure the first profile 20 when interlocked with the second profile 35.

FIG. 4 depicts a second type of the profiles 20 and 35 with interlocking members, which may be used with the present invention. In the figure, a plurality of interlocking members 21 on the first profile 20 is matched to another plurality of interlocking members 21. Similarly, a plurality of interlocking members 21 on the second profile 35 is matched to another plurality of interlocking members 21. The interlocking members are shown in the figure as U-shaped ribs, each with an inward-facing single barbed end section 72 at the ends of the "U". During packaging, the barbed end sections of the first profile 20 secure the first profile when interlocked with the barbed end sections of the second profile 35.

FIG. 5 depicts a third type of the profiles 20, 35 with interlocking members, which may be used with the present invention. In the figure, a plurality of interlocking members 21 on the first profile 20 is matched to another plurality of interlocking members 21. Similarly, a plurality of interlocking members 21 on the second profile 35 is matched to another plurality of interlocking members 21. The interlocking members are shown in the figure as male ribs with double barbed end sections 68 and as U-shaped ribs with inward-facing single barbed end-sections 72. During packaging, the barbed end sections of the first profile 20 secure the first profile when interlocked with the barbed end sections of the second profile 35.

Figure 6:
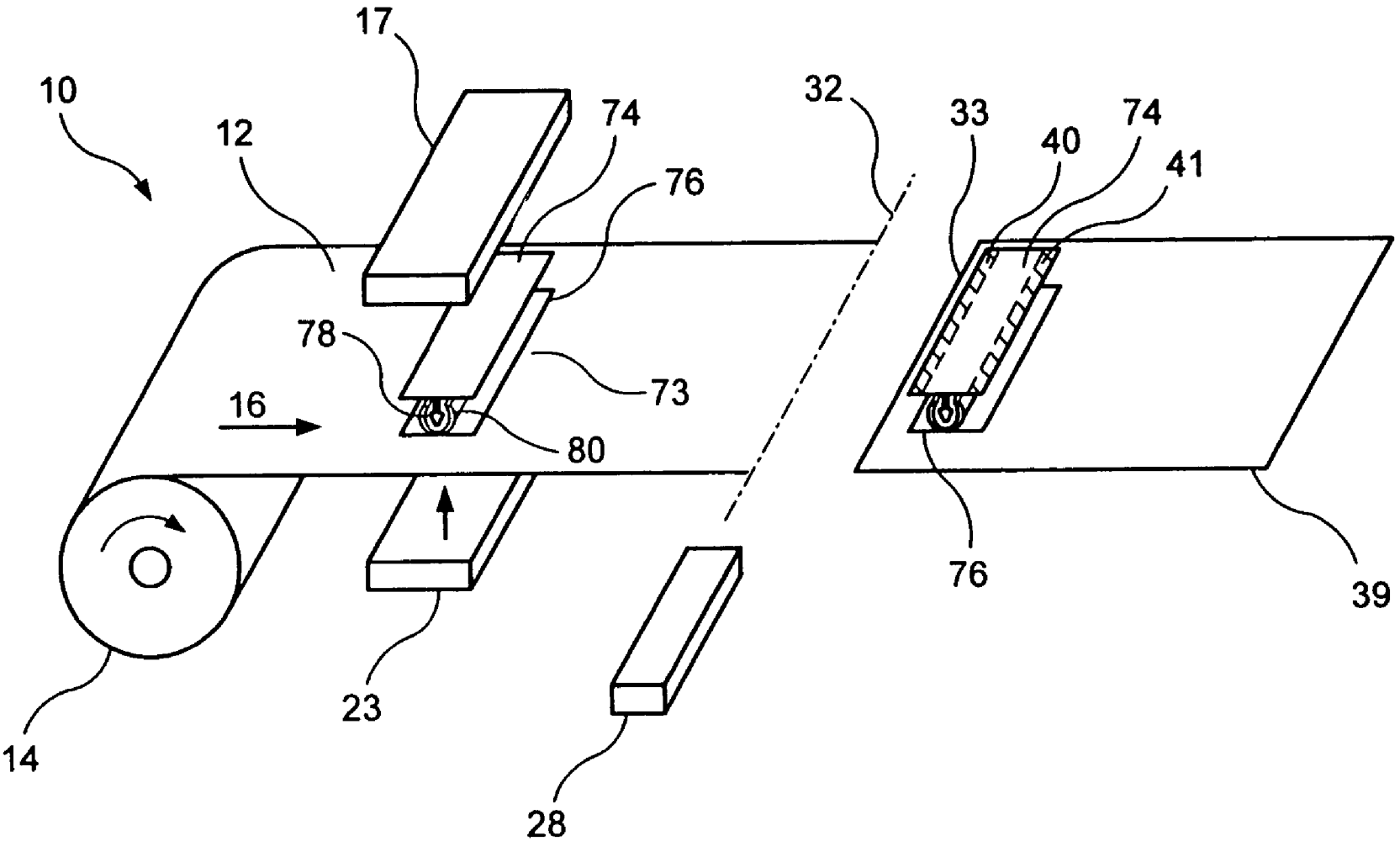
FIG. 6 is a perspective view of a second embodiment of the present invention during a zipper placement operation.

FIG. 6 depicts the package-making apparatus 10 of a second embodiment of the present invention. In the figure, a continuous length of thermoplastic packaging film 12 is dispensed flat from a supply dispenser 14 in direction 16. The packaging film 12 is advanced in direction 16 for a spacing to accommodate at least one product.

The zipper dispenser 17 feeds a zipper 73 to the packaging film 12. The zipper 73, with profiles 74 and 76 engaged by their interlocking members, is sealed by the sealing bar 23 to the midsection of the film. The zipper 73 extends transverse to the longitudinal edges 24 and 25 of the film with only the profile 76, resting on the packaging film 12, being attached to the film. The other profile 74 is secured by the engagement of the interlocking members of the profiles. The zipper 73 may include interlocking members such as an arrow 78 and a tulip 80. The zipper may also include a slider, interlocking members such as those detailed in FIGS. 3, 4 and 5, or other interlocking members known to those skilled in the art.

After the zipper 73 is attached to the packaging film 12, the cutter 28 cuts the packaging film. The cutter cuts along the axis 32 with the cut 33 positioned adjacent to the zipper 73 on a side of the zipper opposite to the direction 16. After the first cut 33 is made, a packaging sheet 39 is produced. The upper peel film area 40 and the lower peel film area 41 are shown on the profile 74; however, the upper and lower peel film areas may alternatively be positioned on the profile 76.

Figure 7:
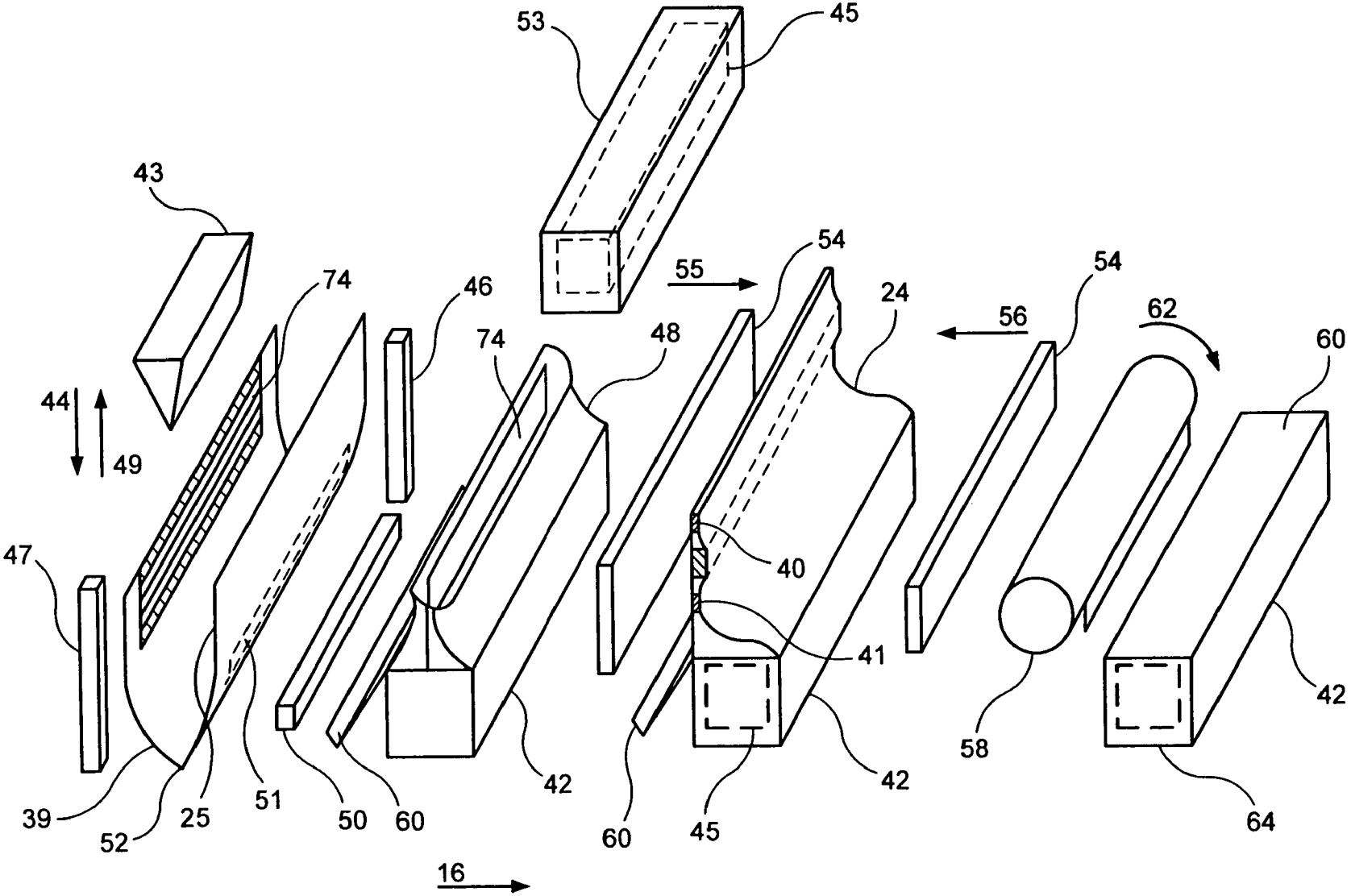
FIG. 7 is a perspective view of the second embodiment of the present invention during a packaging film and a product placement.

As shown in FIG. 7, the packaging sheet 39 is ultimately placed in a box 42. The fold blade 43, moving in direction 44, folds and separates the packaging sheet with enough space to allow placement of a block of cheese or another product 45. Seal bars 46 and 47 seal the longitudinal edges 24 and 25 while the packaging sheet 39 is separated. After the sealing of the longitudinal edges, a resultant envelope 48 is formed. Another seal bar 50 seals the packaging sheet 39 to form a transverse peel seal 51 adjacent to the fold 52. After the envelope 48 is formed, the fold blade 43 is retracted in direction 49.

The product dispenser 53 places the envelope 48 and the product 45 in the box 42. Once the envelope 48 and the product 45 have been placed in the box 42, the packaging sheet is sealed to profile 74 by the sealing device 54 moving in the directions 55 and 56. The sealing device 54 also seals one or both of the peel film areas 40 and 41. A box closer 58 folds the envelope 48 and lowers a box lid 60 in direction 62, thereby enclosing a reclosable product package 64 in the box 42. During use of the resultant product package 64 and after the product 45 is removed, the peel seal 51 may be opened. The opened peel seal increases the volume of the product package 64 allowing easy reinsertion of the product 45 into the package.

Figure 8:
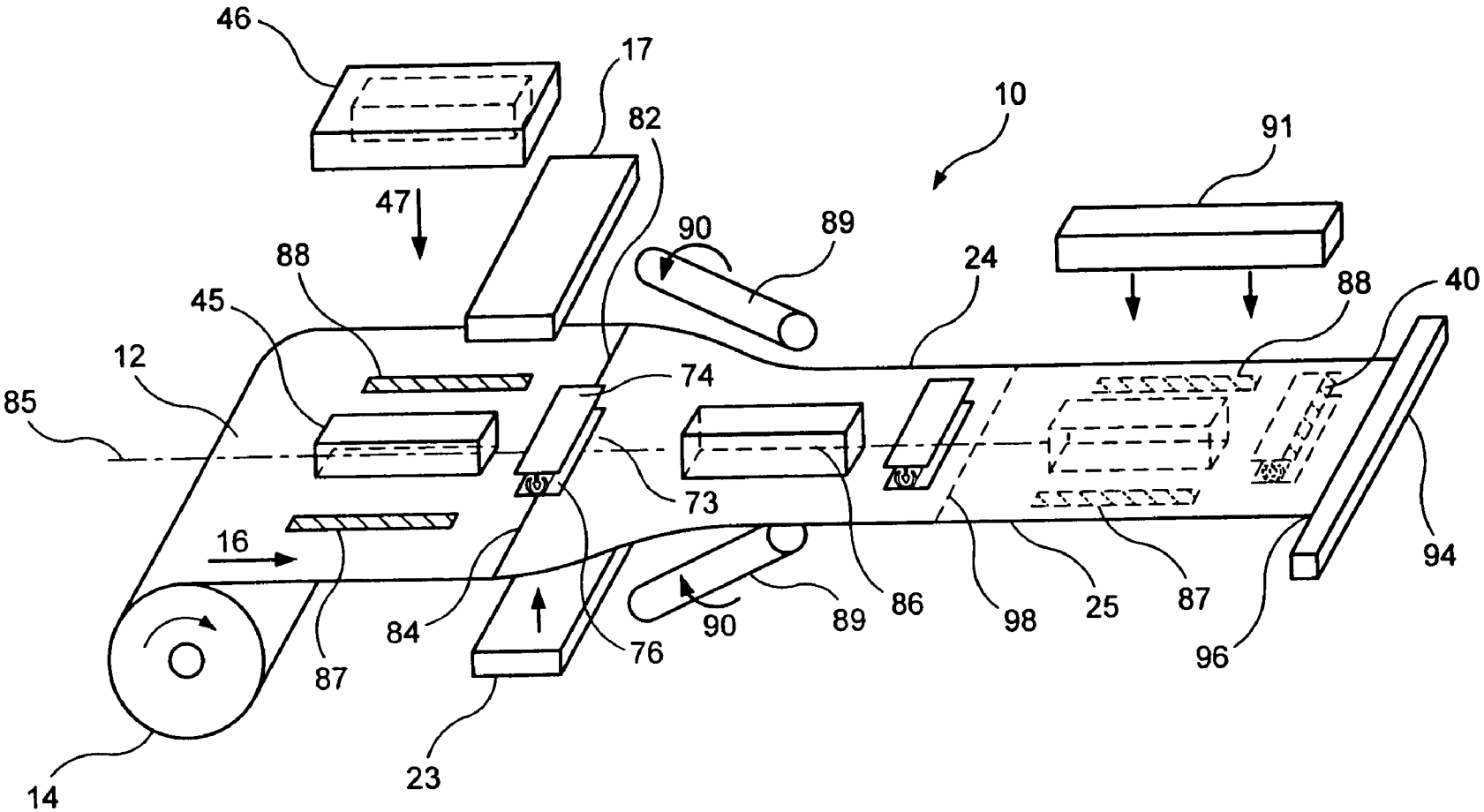
FIG. 8 is a perspective view of a third embodiment of the present invention during a zipper and product placement.

FIG. 8 depicts the package-making apparatus 10 of a third embodiment of the present invention. In the figure, a continuous length of thermoplastic packaging film 12 is dispensed flat from the supply dispenser 14 in the direction 16.

The zipper dispenser 17 feeds a zipper 73 to the packaging film 12. The zipper 73, with profiles 74 and 76 engaged by their interlocking members, is sealed by the sealing bar 23 to a midsection of the packaging film 12. The zipper 73 extends transverse to the longitudinal edges 24 and 25 of the film with only the profile 76, resting on the packaging film 12, being attached to the film. The other profile 74 is secured by the engagement of the interlocking members. Side margins 82 and 84 of the packaging film 12, extending to the longitudinal edges 24 and 25, are provided on opposite sides of the zipper 73. In this regard, the combined length of the side margins 82 and 84 is greater than that of the zipper 73 to allow proper sealing, as discussed in a further step of the method.

Figure 9A:
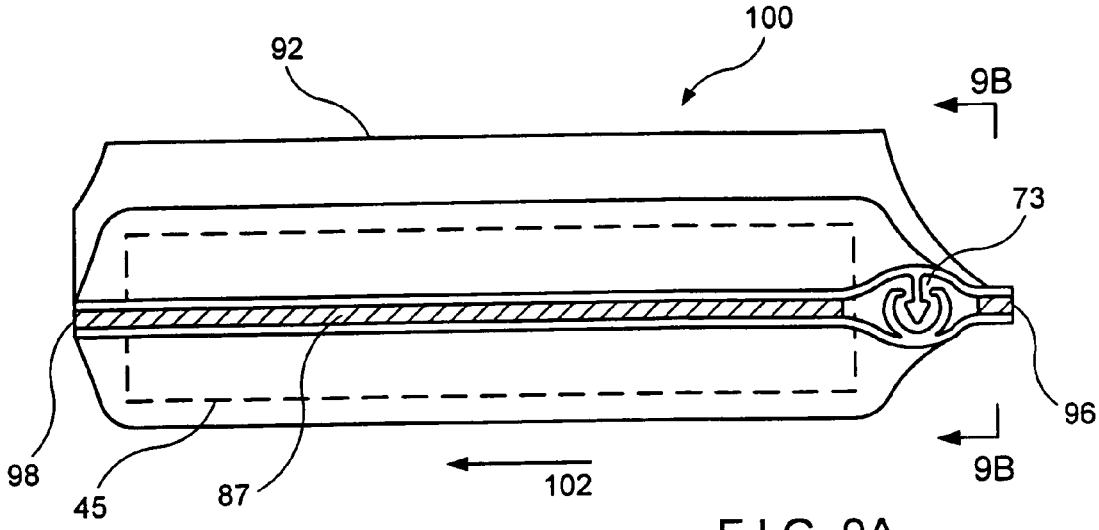
FIG. 9A is a side view of a reclosable product package produced from the third embodiment of the present invention with the view taken from reference line 9A-9A of FIG. 9B.
Figure 9B:
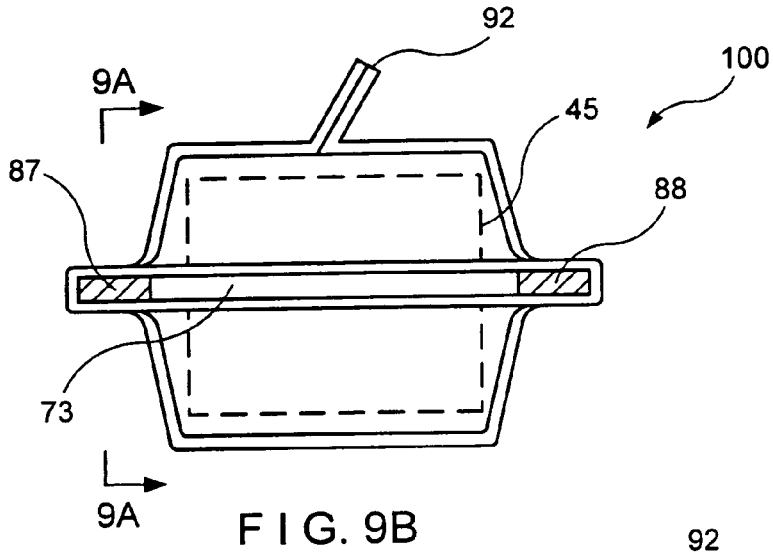
FIG. 9B is an end view of the reclosable product package produced from the third embodiment of the present invention with the view taken from reference line 9B-9B of FIG. 9A.

The product 45 is placed onto the packaging film 12 by the product dispenser 49. In the figure, the product 45 is placed along a central axis 85 of the packaging film 12. When the product 45 is placed in this position, the resultant reclosable product package 100 is depicted in FIGS. 9A and 9B. Alternatively, if the product 45 is first placed with an edge 86 on the central axis 85, the resultant reclosable product package 100 is depicted in FIG. 10.

As shown in FIG. 8, peel film areas 87 and 88 are disposed adjacent to the product 45. The peel film areas 87 and 88 provide a fold-back opening area for the product package, as will be discussed later. After the zipper is attached to the film and the product 45 is placed, a fold-guide 89 serves to continuously fold the packaging film 12 over the product in direction 90. A sealing device 91 seals the peel film areas 87 and 88 and seals the side margins 82 and 84 to form a tube. A fin 92 sealing the tube shape of the packaging film 12 is shown in FIGS. 9A, 9B and 10.

As shown in FIG. 8, a cross-jaw section 94 seals and cuts a leading edge 96. After movement in direction 16, the cross-jaw section 94 seals the side margins 82 and 84 to the profile 74. The upper peel film area 40 shown on the profile 74 may be sealed to provide a peel seal or the leading edge 96 may be sealed to provide a cut-open section. After continued movement in direction 16, the cross-jaw section 94 cuts a trailing edge 98 with the result of a reclosable product package 100.

Figure 10:
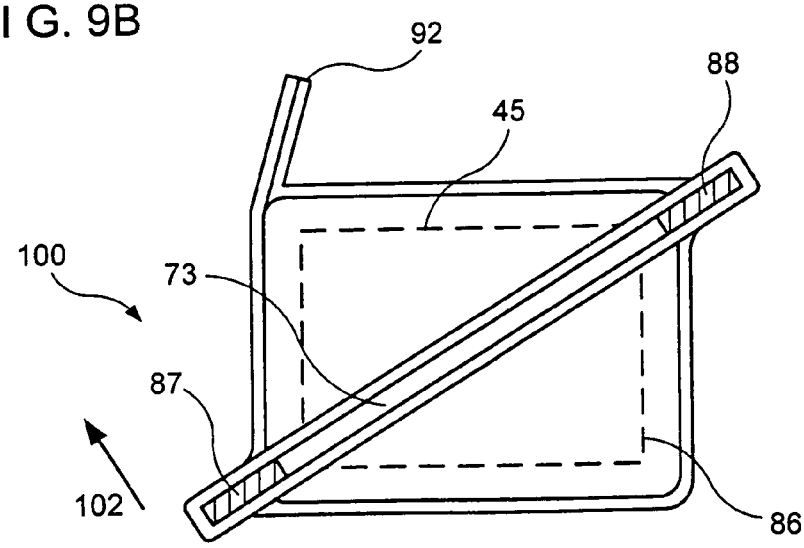
FIG. 10 is an end view of the reclosable product package produced from the third embodiment of the present invention with an end seal removed to illustrate the zipper and peel seal sections of the reclosable product package.

The reclosable product package 100 manufactured in the third embodiment of the present invention is shown in FIGS. 9A, 9B and 10. For manufacturing the product package 100 of FIGS. 9A and 9B, the product 45 is placed along a central axis 85 of the packaging film 12 before the packaging film under-wraps the product. When the leading edge 96 or a peel seal at the leading edge is separated, the zipper 73 can be accessed. To access the product 45, the zipper 73 is opened and the peel film areas 87 and 88 are peeled back and outward in direction 102 to coincide with the quantity of the product desired by the user. The peel film areas 87 and 88 peel back to increase the inner diameter of the product package 100 without tearing the package. Without tearing the product package 100 during opening, the package can be resealed by the zipper 73.

Alternatively, for manufacturing the product package 100 of FIG. 10, the product 45 is first placed with an edge 86 on the central axis 85 before the packaging film under-wraps the product. See FIG. 8 for the product placement. Similar to opening the product package depicted in FIGS. 9A and 9B, the zipper 73 of FIG. 10 is opened and the peel film areas 87 and 88 are peeled back and outward in direction 102.

Figure 11:
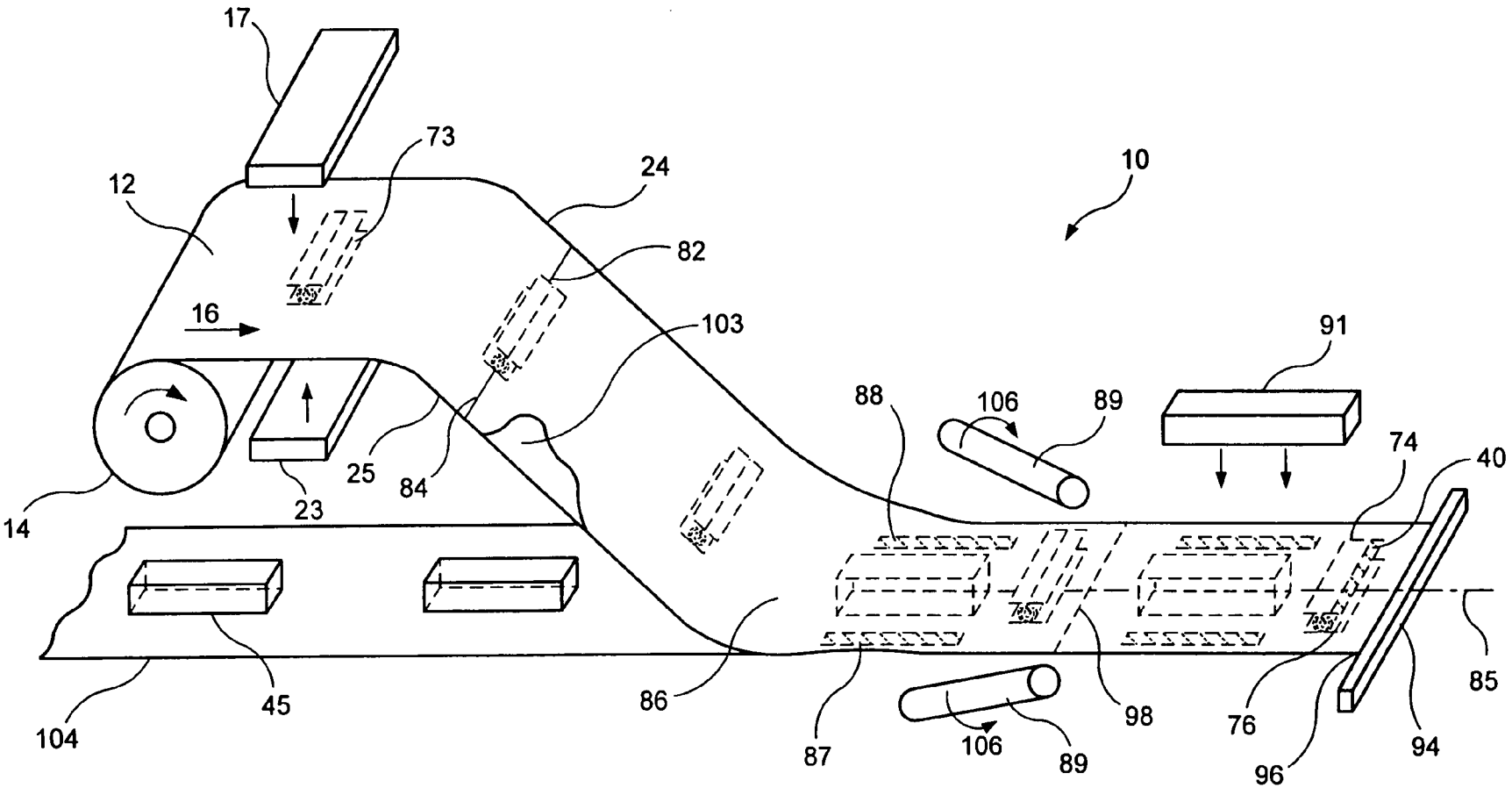
FIG. 11 is a perspective view of a fourth embodiment of the present invention during a zipper and product placement.

FIG. 11 depicts the package-making apparatus 10 of a fourth embodiment of the present invention. In the figure, a continuous length of thermoplastic packaging film 12 is dispensed flat from the supply dispenser 14 in direction 16.

The zipper dispenser 17 feeds a zipper 73 to an underside 103 of the packaging film 12. The zipper 73, with the profiles 74 and 76 engaged by their interlocking members, is sealed by the sealing bar 23 to a midsection of the packaging film 12. The zipper 73 extends transverse to the longitudinal edges 24 and 25 of the film with only the profile 76, resting on the packaging film 12, being attached to the film. The other profile 74 is secured by the engagement of the interlocking members. Side margins 82 and 84 of the packaging film 12, each extending to the longitudinal edges 24 and 25, are provided on opposite sides of the zipper 73. In this regard, the combined length of the side margins 82 and 84 is greater than that of the zipper 73 to allow proper sealing as discussed in a further step of the method.

The packaging film 12 advances in direction 16 to cover the product 45. In the figure, a product dispenser 104 places the product 45 to align with the central axis 85 of the packaging film 12. When the product 45 is placed in this position, the resultant product package is depicted in FIGS. 9A and 9B. Alternatively, if the product 45 is placed with a longitudinal edge 86 aligned with the central axis 85, the resultant product package 100 is depicted in FIG. 10.

As shown in FIG. 11, peel seal areas 87 and 88 are disposed adjacent to the product 45. Similar to the under-wrap method of the third embodiment, the peel film areas 87 and 88 provide a fold-back opening area for the product package.

After the zipper 73 is attached to the film and the product 45 is placed, a fold-guide 89 serves to continuously fold the packaging film 12 under the product in direction 106. The sealing device 91 seals the side margins 82, 84 to each other while sealing the peel film areas 87 and 88 to form a tube. The sealing device 91 also seals the longitudinal edges 24 and 25 to form the fin 92, shown in FIGS. 9A, 9B and 10.

As shown in FIG. 11, the cross-jaw section 94 seals and cuts the leading edge 96. The leading edge 96 may be sealed to provide a cut-open section. After movement in direction 16, the cross-jaw section 94 seals the side margins 82 and 84 to the exposed profile 74 of the zipper 73. The upper peel film area 40 (shown as a heavily bordered area on the profile 74 for illustrative purposes) may be sealed to provide a peel seal. After continued movement in direction 16, the cross-jaw section 94 cuts and seals a trailing edge 98. A product package 100 manufactured in the fourth embodiment of the present invention is shown in FIGS. 9A, 9B and 10.

Figure 12:
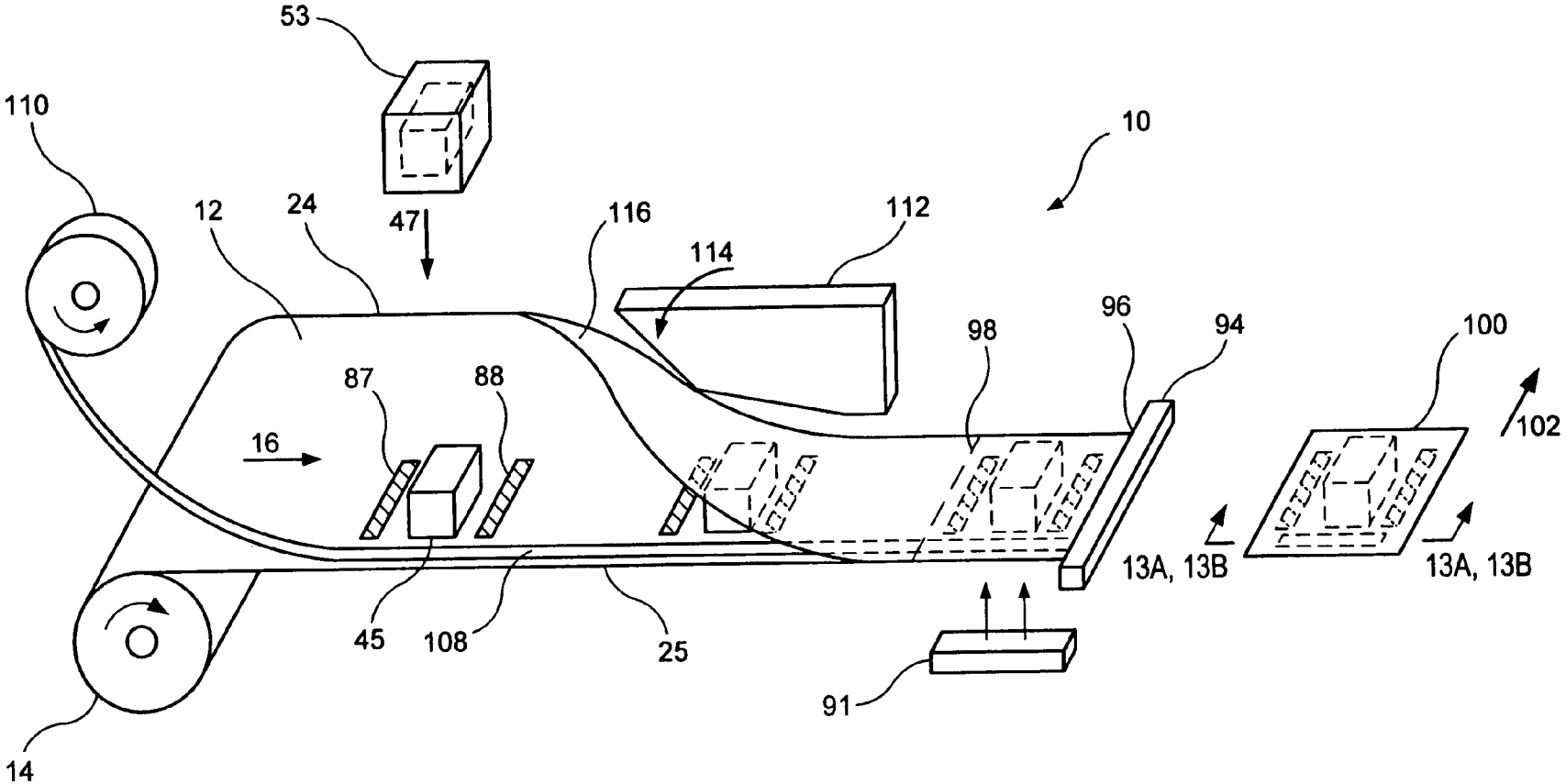
FIG. 12 is a perspective view of a fifth embodiment of the present invention during a zipper and product placement.

FIG. 12 depicts the package-making apparatus 10 of a fifth embodiment of the present invention. In the figure, a continuous length of thermoplastic packaging film 12 is dispensed flat from the supply dispenser 14 in direction 16.

A product 45 is placed onto the packaging film 12 by the product dispenser 49. The product 45 is placed along a longitudinal half of the packaging film 12 transverse to the longitudinal edges 24 and 25. A zipper 108 with interlocked profiles is fed from a continuous supply 110 to a lengthwise area between the product 45 and the longitudinal edge 25 of the film. The peel film areas 87 and 88 are located adjacent to the product 45 and transverse to the longitudinal edges 24 and 25. Similar to the under-wrap method of the third embodiment and the over-wrap method of the fourth embodiment, the peel film areas 87 and 88 provide a fold-back opening area for the product package.

After the zipper 108 is fed to the packaging film 12, a fold-guide 112 serves to continuously fold the packaging film over the product 45 in direction 114, so that ultimately the two longitudinal edges 24 and 25 are brought into alignment with each other. After the folding operation is complete, the zipper 108 and the product 45 are covered by a folding portion 116 of the packaging film 12.

Figure 13A:
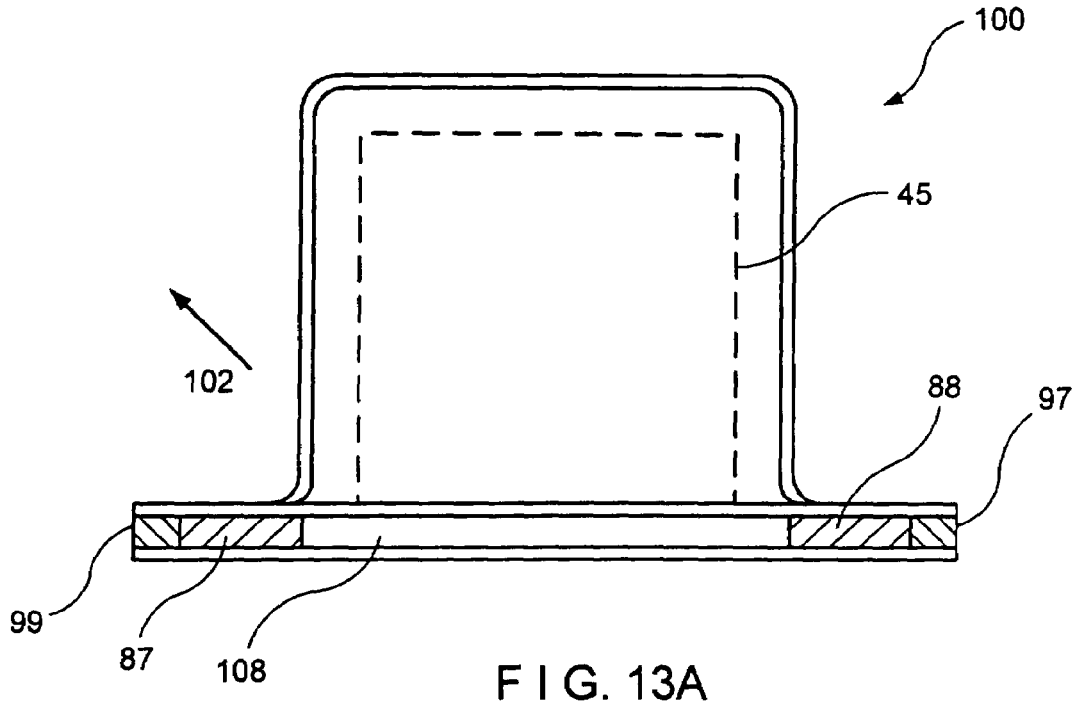
FIG. 13A is an end view of the reclosable product package produced from the fifth embodiment of the present invention with the view taken from reference line 13A-13A of FIG. 12.
Figure 13B:
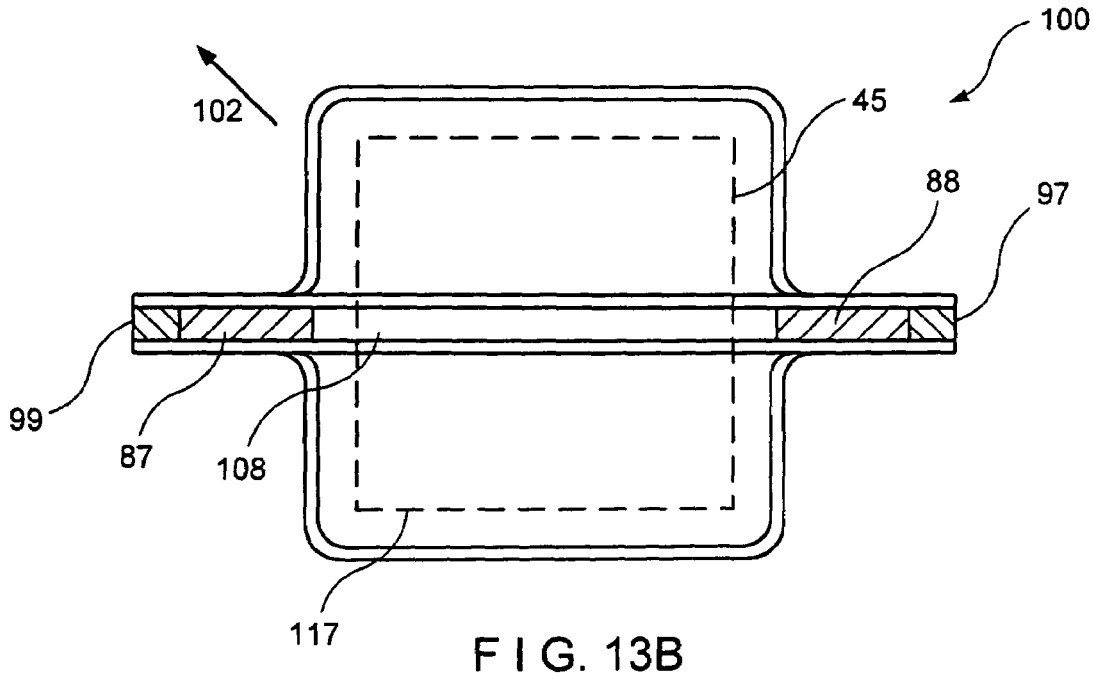
FIG. 13B is an end view of the reclosable product package produced from the fifth embodiment of the present invention with the view taken from reference line 13B-13B of FIG. 12.

Downstream of the fold-guide 112, and when the longitudinal edges 24 and 25 are brought into alignment, a sealing operation is performed by the sealing device 91. The sealing device 91 seals the longitudinal edges 24, 25 to each other and the zipper 108 to the packaging film 12. Downstream of the sealing device 91 is the cross-jaw section 94, which cuts and seals the leading edge 96 to form the side seal 97, shown in FIGS. 13A and 13B. The cross-jaw section 94 further cross-seals the peel film areas 87 and 88 to the packaging film 12 as well as sealing the trailing edge 98 to form a side seal 99. A reclosable product package 100 is shown in FIG. 13A. To form the reclosable package 100 of FIG. 13B, the sealing device 91 seals the longitudinal edges 24, 25 above a lower portion 117 of the product 45.

When accessing the product 45, the user opens the zipper 108 of the reclosable package 100 and peels the peel film areas 87 and 88 back and outward in direction 102 to coincide with the quantity of the product desired by the user. The peel film areas 87 and 88 are peeled back to increase the inner diameter of the product package 100 without tearing the package. Without tearing the product package 100 during opening, the package can be resealed by the zipper 108.

Figure 14:
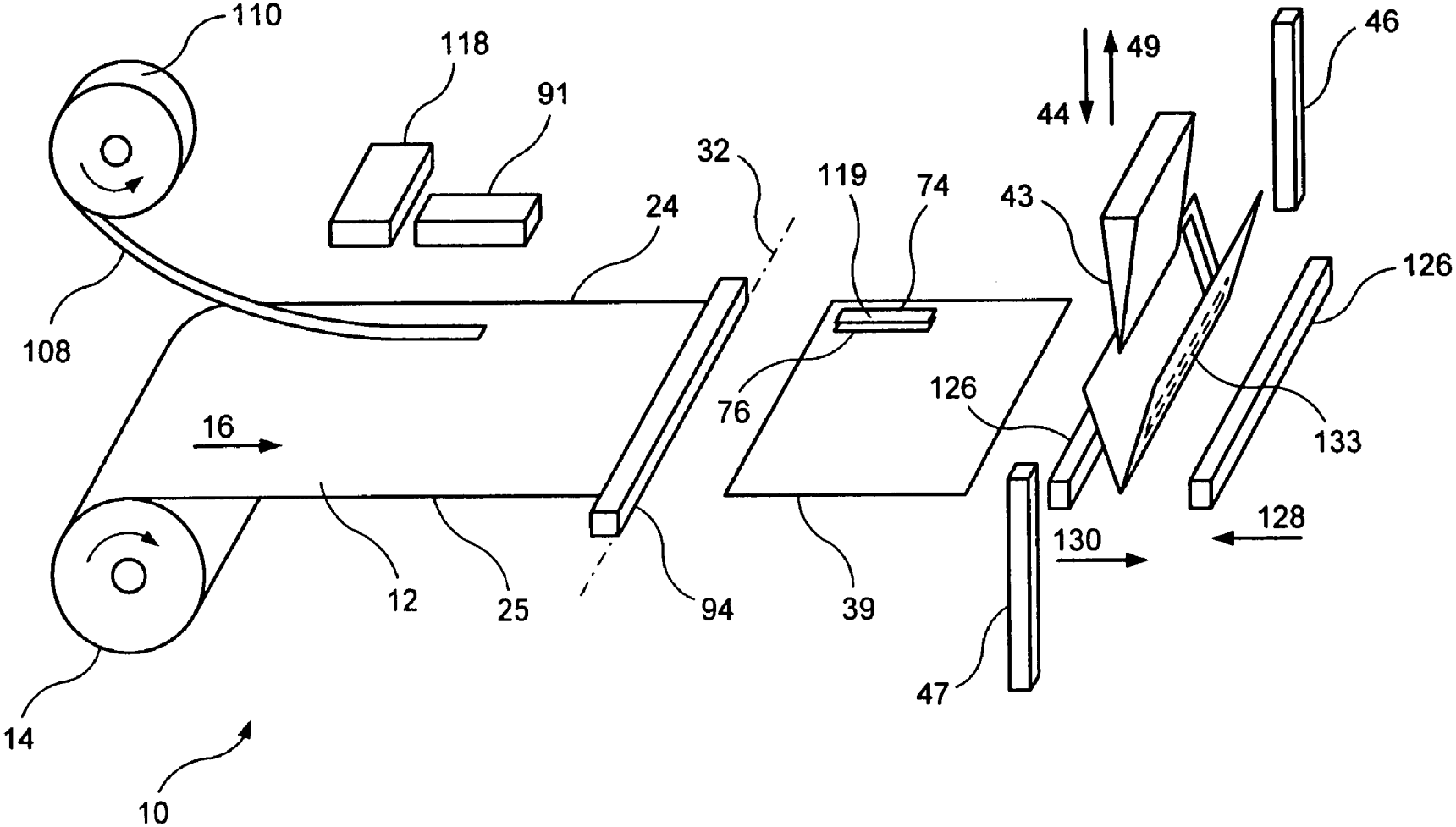
FIG. 14 is a perspective view of a sixth embodiment of the present invention during a zipper placement and a folding operation.

FIG. 14 depicts the package-making apparatus 10 of a sixth embodiment of the present invention. In the figure, a continuous length of packaging film 12 is dispensed flat from the supply dispenser 14 in direction 16. With the packaging film advanced to accommodate a consumer product 45, a zipper 108 with interlocked profiles 74 and 76 is fed from a continuous supply 110 to an area adjacent to the longitudinal edge 24 of the film. A cutter 118 cuts a zipper length 119. The zipper length 119, with profiles 74 and 76 joined by their interlocking members, is sealed by the sealing bar 91 to the packaging film 12 with only the profile 76, resting on the packaging film 12, being attached to the film. The other profile 74 is secured by the engagement of the interlocking members of the profile.

Figure 16:
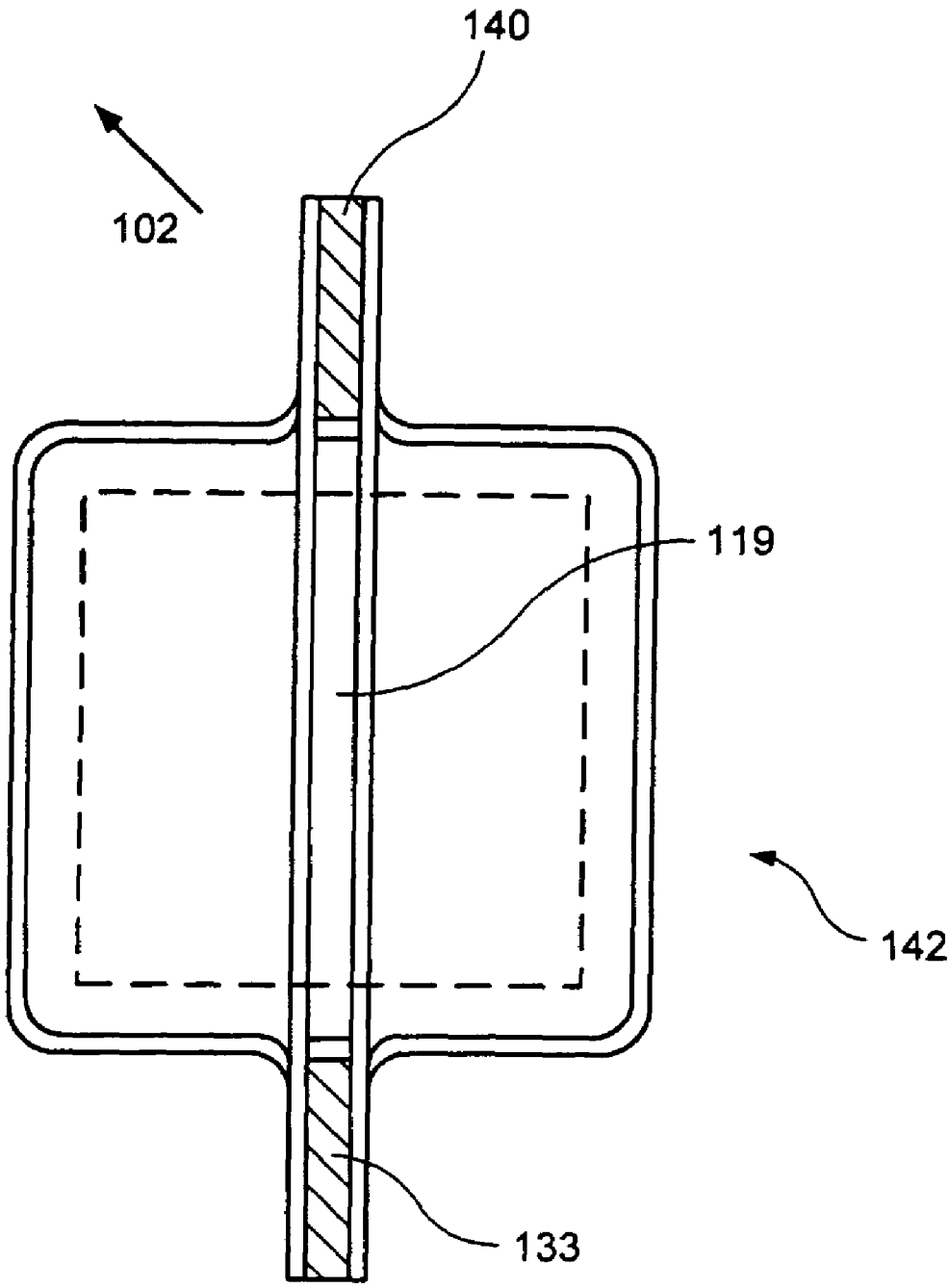
FIG. 16 is an end view of the reclosable product package produced from the sixth embodiment with an end seal removed to illustrate the zipper and peel seal sections of the reclosable product package.

Downstream of the sealing device 91, the cross-jaw section 94 cuts the packaging film 12 along the axis 32 transverse to the longitudinal edges 24 and 25 to produce a packaging sheet 39. The fold blade 43, moving in direction 44, folds and separates the packaging sheet with enough space to allow placement of a block of cheese or another product 45. The seal bars 46 and 47 seal the longitudinal edges 24 and 25 while the packaging sheet 39 is separated. The seal bar 46 also seals the exposed profile 74 of the zipper length 119 to the packaging film 12 as well as a peel area 40 or 41 that may be provided with the zipper. Another sealing bar 126 folds and seals the packaging sheet 39 in directions 128 and 130 thereby creating a peel seal 133. A resultant envelope 134 is shown in FIG. 16. After sealing of the longitudinal edges, the fold blade 43 is retracted in direction 49.

Figure 15:
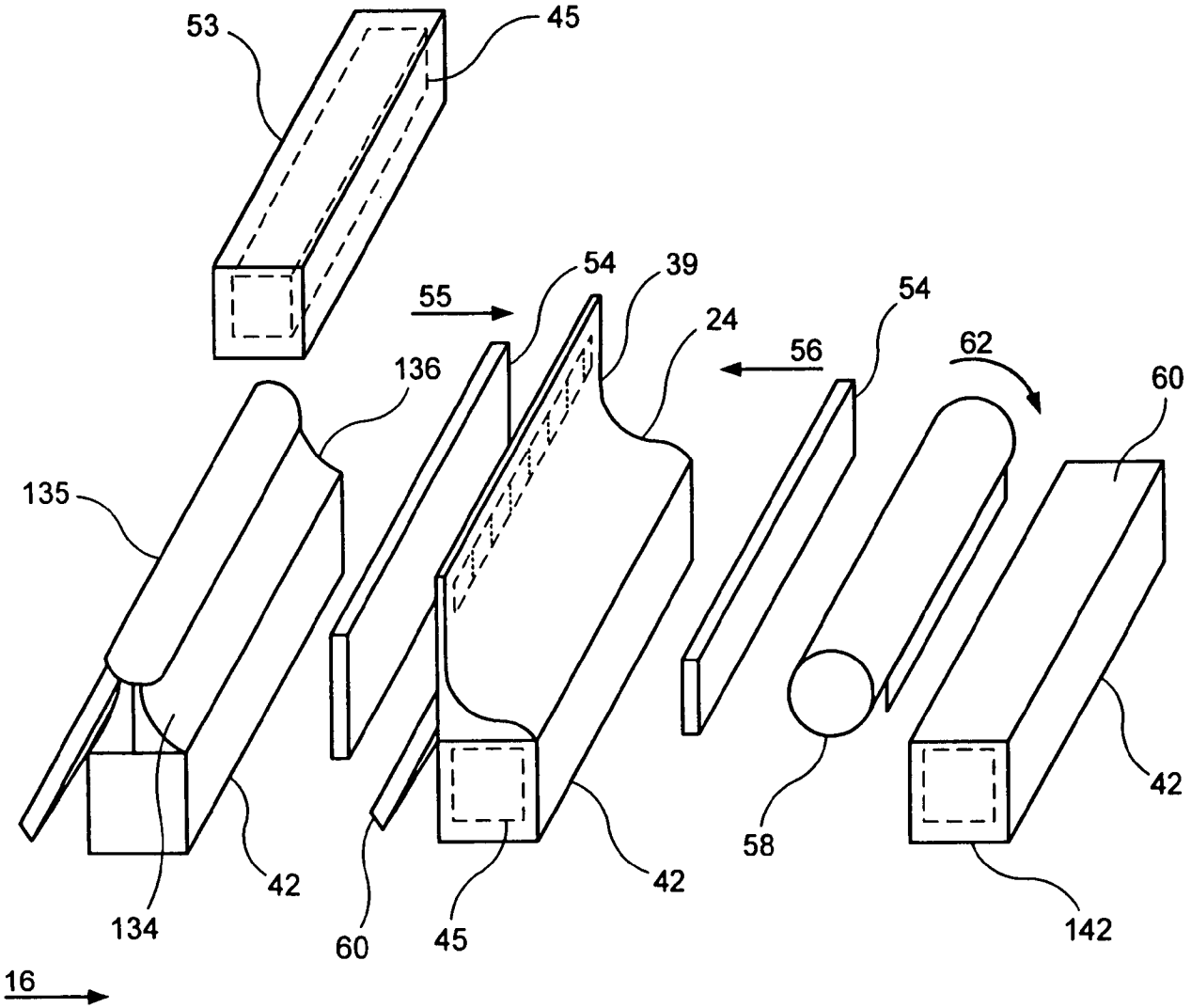
FIG. 15 is a perspective view of the sixth embodiment of the present invention during a packaging film and a product placement.

As shown in FIG. 15, the product dispenser 53 places the envelope 134 and the product 45 in the box 42. The product 45 is shown as a block; however, the product may in liquid form to fill a sealed area of the envelope 134. Once the envelope 134 and the product 45 have been placed in the box 42, the sealing device 54 moving in directions 55 and 56 seals transverse edges 135 and 136 to form a peel seal 140, shown in FIG. 16. The box closer 58 folds the envelope 34 and lowers a box lid 60 in direction 62, thereby enclosing a reclosable product package 142 in the box 42.

A reclosable product package 142 manufactured in the sixth embodiment of the present invention is shown in FIG. 16. When the zipper 119 is opened, the peel seals 133 and 140 are peeled back and outward in direction 102 to coincide with the quantity of the product desired by the user. The peel seals 133 and 140 peel back to increase the inner diameter of the product package 142. Without tearing the product package 142 during opening, the package can be resealed by the zipper 119.

Thus, the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A method for packaging products, comprising the steps of:

supplying a continuous length of packaging film having opposed longitudinal edges;

advancing the packaging film to accommodate a product;

supplying a zipper having a first profile with a first interlocking member and a second profile with a second interlocking member with the first and second interlocking members in an interengaged position;

attaching the first profile to the packaging film transverse to the longitudinal edges of the packaging film;

cutting the packaging film adjacent to the first profile to form a packaging sheet;

folding the packaging sheet at a fold transverse to the longitudinal edges;

sealing opposing inner surfaces of the longitudinal edges to form an envelope;

placing the envelope in a box with the zipper and an opposing face of the envelope opposite to the zipper protruding from the box;

placing the product into an envelope in the box;

sealing the second profile of the zipper to the packaging sheet while the envelope is in the box; and forming a reclosable product package in the box.

2. The method in accordance with claim 1 further including the step of sealing the opposing inner surfaces of the packaging sheet adjacent to the fold of the packaging sheet with a transverse peel seal.

3. The method in accordance with claim 2, further including the step of sealing a portion of the first profile to a portion of the second profile with a peel seal.

4. An apparatus for packaging products comprising:

a packaging film dispenser which supplies a continuous length of packaging film having opposed longitudinal edges;

a zipper dispenser which feeds a continuous supply of zippers, with the zippers including a first profile with a first interlocking member and a second profile with a second interlocking member wherein the first and second profiles are interengaged by the first and second interlocking members;

a sealing bar which attaches a first profile of a dispensed zipper transversely to the packaging film at spaced intervals;

a cutter which cuts adjacent to the zipper for a packaging sheet that can accommodate at least one product;

a folding blade which folds the packaging sheet at a fold transverse to the longitudinal edges;

a first sealing device which seals opposing inner surfaces of the fold at the longitudinal edges to form an envelope;

a product dispenser which fits the envelope and the product in a box;

a second sealing device which seals the second profile of the zipper to the packaging sheet while the envelope is in the box; and a box closer which forms a reclosable product package in the box.

5. The apparatus in accordance with claim 4 further including a third sealing device which seals opposing inner surfaces of the packaging sheet adjacent to the fold of the packaging sheet with a transverse peel seal.

6. The apparatus in accordance with claim 4, wherein the second sealing device seals a portion of the first profile to a portion of the second profile of the zipper with a peel seal.

* * * * *